United States Patent [19]

Gould

[11] Patent Number: 4,938,462

[45] Date of Patent: Jul. 3, 1990

[54] RESEALABLE PACKAGE

[76] Inventor: Charles E. Gould, 928 Central Dewey La., Nampa, Id. 83687

[21] Appl. No.: 478,439

[22] Filed: Feb. 12, 1990

[51] Int. Cl.[5] ..... B65D 75/58
[52] U.S. Cl. ..... 206/470
[58] Field of Search ..... 206/467, 470

[56] References Cited

U.S. PATENT DOCUMENTS

| | | | |
|---|---|---|---|
| 2,963,150 | 12/1960 | Dgetluck | 206/470 |
| 3,174,621 | 3/1965 | Watson | 206/470 |
| 3,581,885 | 6/1971 | Wald | 206/470 |
| 3,967,730 | 7/1976 | Driscoll et al. | 206/470 |
| 4,106,621 | 8/1978 | Sorenson | 206/470 |
| 4,300,682 | 11/1981 | Kuchenbecker | 206/470 |
| 4,569,442 | 2/1986 | Bushey | 206/470 |

FOREIGN PATENT DOCUMENTS

| | | | |
|---|---|---|---|
| 750764 | 11/1970 | Belgium | 206/470 |
| 750765 | 11/1970 | Belgium | 206/470 |
| 1570711 | 6/1969 | France | 206/470 |
| 6406590 | 12/1965 | Netherlands | 206/470 |
| 927035 | 5/1963 | United Kingdom | 206/470 |
| 2034662 | 6/1980 | United Kingdom | 206/470 |

*Primary Examiner*—William I. Price
*Attorney, Agent, or Firm*—Frank J. Dykas; Craig M. Korfanta

[57] ABSTRACT

A resealable blister package wherein the top planar surface of the blister package assembly is divided into first and second portions by means of a transverse concave indentation formed integrally therein. The first or lower portion of the blister package assembly is permanently attached to a planar base surface, with the second or upper portion being attached at its flanges by use of a resealable adhesive.

9 Claims, 3 Drawing Sheets

RESEALABLE PACKAGE

BACKGROUND OF THE INVENTION

1. Technical Field.

This invention relates to resealable packages, and more particularly to a resealable blister type package for displaying packaged goods in a container which can be opened and resealed without obvious or apparent damage.

2. Background Art.

A form of packaging commonly used in retail merchandising is the blister package designed for pegboard display. Generally, these types of packages have a cardboard backing, upon which product or advertising information is printed, and to which is attached a clear plastic blister assembly to form a container in which goods are displayed and held. A hole is formed at the top of the cardboard backing so that the package can be held on an extended peg of a pegboard display. In this manner large volumes of varied items can be held on a pegboard, in stores where shelf space is at a premium.

This type of packaging is used for numerous and varied types of items and would include such things as small quantities of nails, thumb tacks, cosmetic toiletry articles, and other small items too numerous to mention. In the usual case, blister packaging is required when it is desirable to provide a convenient way of merchandising preselected number of units, such as a package containing twenty small finish nails. A second object of the conventional blister pack is to provide security for the goods, because the blister package is substantially bigger than the goods themselves, which makes pilferage and shop-lifting much more difficult. An example of this would be a ballpoint pen, which if offered for sale in bulk and contained in a shelf bin, could easily be pilfered merely by picking up and inserting one in a shirt pocket. On the other hand, if held in a blister package, pilferage is a much more difficult and risky task, since the pilferer must break open the package to remove the pilferable contents.

As a result, most of the developments work in the past has been directed toward providing blister packages which are destroyed when opened. Typically, these blister packaging devices have a cardboard backing to which is attached a clear plastic assembly. An adhesive plastic material is first sprayed onto the surface of the card-board, usually the entire surface in cases where the blister packaging is of the same relative size as the cardboard backing. Then the cardboard backing is positioned atop the blister pack assembly, together with its contents, and heat is applied to the flanged edges of the blister pack to bond the cardboard, plastic adhesive and blister pack assembly flanges together. This process is called heat sealing.

In order to open the package, the plastic assembly must be torn from the cardboard backing. An improvement in common use today, includes providing perforations in the cardboard backing to facilitate access to the goods through the cardboard.

The problem arises when it is desired to provide blister packaging suitable for pegboard display, wherein the blister pack can easily be opened and resealed without apparent damage to the packaging itself. This would be of value in situations where it is desireable to remove the goods from the package for inspection prior to purchase, or in cases where intended use of the goods is such that the purchaser will use only a few items at a time and wish to store, in the original packaging, the remaining items. Examples of these situations would be where a prospective purchaser of an archery bow string would desire to inspect the entire string prior to purchase, or, a package of small finish nails wherein the purchaser may purchase twenty nails when only two or three are needed, with the rest to be stored for future use.

A resealable blister type packaging assembly is disclosed in BACKMAN, ET AL., U.S. Pat. No. 4,586,316. It provides a lid attached to the plastic blister assembly, which wraps around the back of a base plate. Interfitting snap lock assemblies are provided on the blister package flange, and the lid to hold the assembly together. In CROCE, U.S. Pat. No. 4,781,294, a tear package is provided with foamed polypropylene material which has resealable adhesive material on a preselected portion of the package which, after being torn open, can be reattached to the foamed polypropylene material.

While the packages disclosed by Backman, et al. and Croce are reclosable, the package of Croce cannot be used in situations where it is desireable to facilitate inspection of merchandise prior to purchase, since the package will show apparent damage once opened. In the case of Backman, et al. the fact that the package is reclosable will be readily apparent even to the casual observer unless the lip is taped or stapled to the back of the package base.

Accordingly, what is needed is a resealable package which will not show apparent damage when opened and later resealed, and yet will appear as a conventional blister pack which cannot be opened without damage. Another object of this invention is to provide a blister package which is simple and inexpensive to manufacture and assemble.

DISCLOSURE OF INVENTION

These objects are accomplished by use of a packaging system having a planar base surface formed of cardboard, with a heat sealing coating, and a copolyester plastic blister assembly. The plastic blister assembly has a top planar surface with an integrally formed concave indentation extending transversely across the top surface from side to side. The concave indentation defines a boundary line between the lower or first planar surface and an upper, reclosable, second planar surface.

A pair of first opposing side walls and an interconnecting end wall extend from the edges of the lower, first planar surface to form, when the plastic assembly is attached to the base plate, a container for the packaged merchandise. An attachment flange circumvolves the end and side walls of the lower, first portion, and provide an attachment surface for adhesively attaching the plastic container to the backing plate. The plastic blister assembly is permanently attached to the cardboard planar base plate by means of a heat sealing process using a nonresealable adhesive between the first attachment flange and the base plate.

The upper, or second, planar surface, in a like manner, has extending from its sides and end, second or upper end and side walls, and a circumvolving, second attachment flange, all similar in size and appearance to the first or lower end, end wall, side walls and attachment flange. However, in the case of the upper, second attachment flange, it is attached to the planar base plate by means of a resealable, or reusable adhesive.

BRIEF DESCRIPTION OF THE DRAWINGS

FIG. 5 is a perspective representational view of a second embodiment.

BEST MODE FOR CARRYING OUT INVENTION

Figure 1:
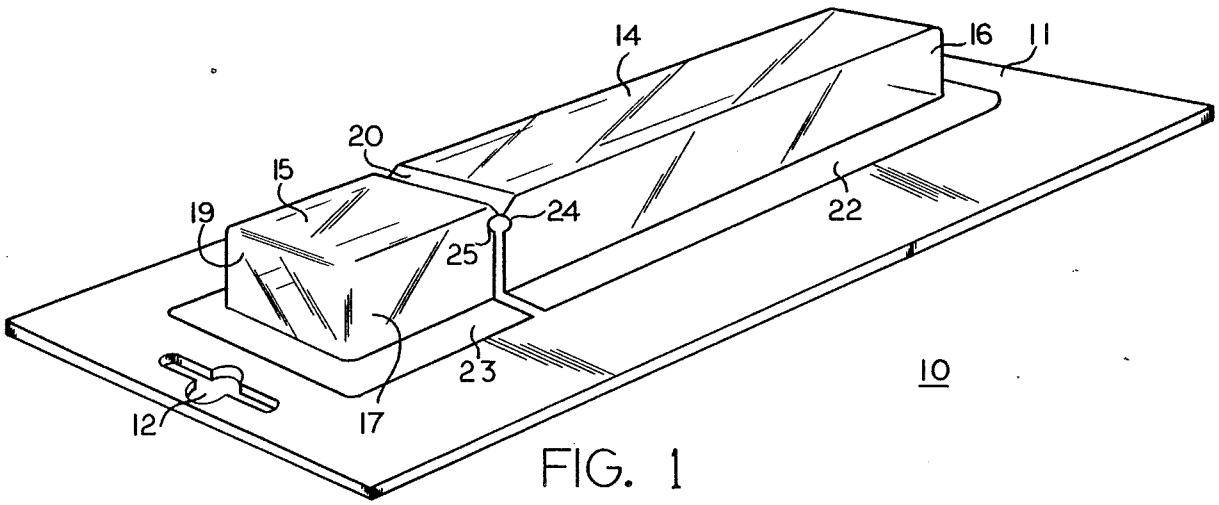
FIG. 1 is a perspective representational view of the resealable blister package assembly in a closed position.
Figure 2:
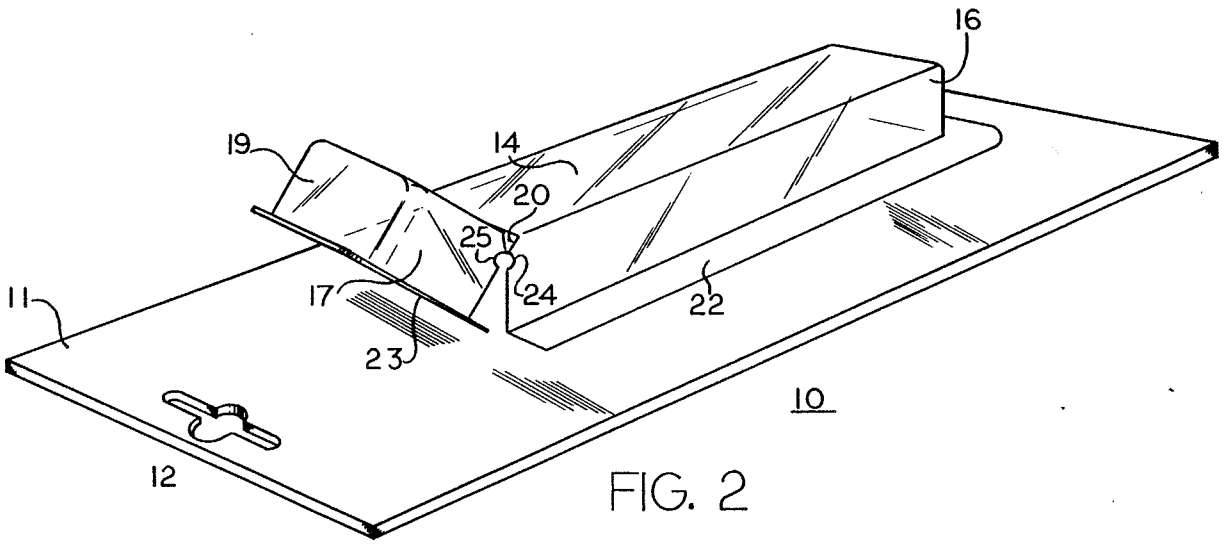
FIG. 2 is a perspective representational view of the resealable blister package assembly in an opened position.
Figure 3:
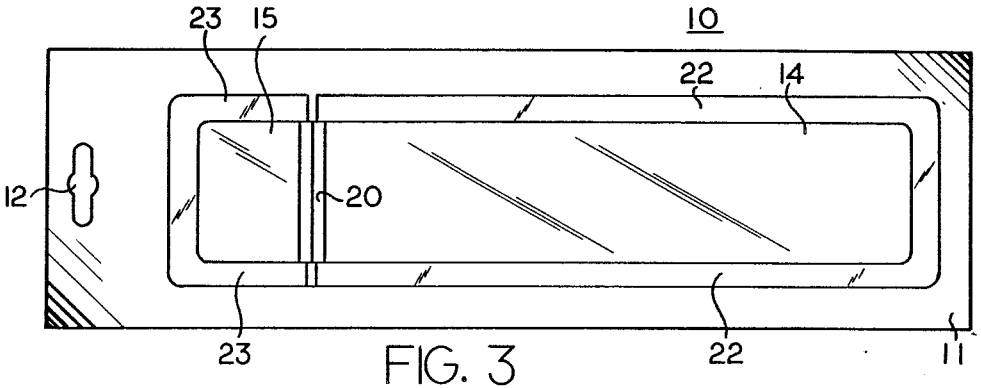
FIG. 3 is a top planar view of the resealable blister package.
Figure 4:
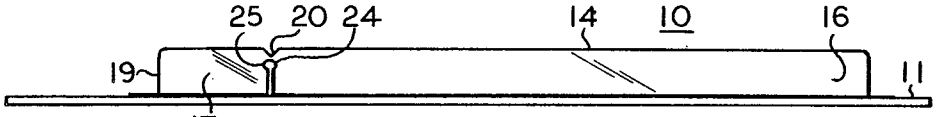
FIG. 4 is a side view of the resealable blister package.

As shown in FIGS. 1, 2 and 3, my plastic blister package assembly 10 is designed to be hung from a peg hook inserted through peg hook hole 12 in cardboard planar base plate 11. A plastic blister assembly 13, formed of unitary construction and preferably of copolyester plastic, typically a glycol modified polyethylene terephthalate, is provided for attachment to planar base plate 11.

Transverse concave indentation 20 is integrally formed in the top surface of plastic assembly 13 and serves as a dividing line between a first or lower portion of planar top surface 14 and upper, second portion of planar top surface 15.

Extending from the sides of lower, first portion planar surface !4 are first portion side walls 16 and an interconnecting first portion end wall 18. Circumvolving side walls 16 and end wall 18 is first portion attachment flange 22. Attachment flange 22 is heat sealed to the base plate 11 for purposes of permanently attaching plastic assembly 13 to base plate 11. When so attached a compartment is formed into which merchandise can be inserted.

In a like manner, the second, or upper portion planar top surface 15 has extending from its sides, second portion side walls 17 and interconnecting second portion end wall 19. Circumvolving side walls 17 and interconnecting end wall 19 is second portion attachment flange 23.

When the upper portion of plastic assembly 13 is in the closed position, with second attachment flange 23 positioned against base plate 11, the blister package assembly 10 appears to be of unitary construction having a single compartment all of which is adhesively attached by means of a circumvolving attachment flange to base plate 11.

In fact however, by providing separate pairs of opposing side walls 16 and 17, and transverse concave indentation 20, the upper portion of plastic assembly 13 can be folded out away from base plate 11 to provide access to the merchandise compartment defined by the lower portion of plastic assembly 13 and base plate 11, as is shown in FIG. 2.

A reusable, resealable adhesive is provided for holding upper attachment flange 23 against base plate 11 when merchandise is displayed in the closed blister package 10. To open the package for temporary removal of goods for purposes of inspection, or removal of some, but not all, of the contents of the package, one merely has to pry upper attachment flange 23 away from base plate 11 to gain access to the lower compartment. To reclose, all that has to be done is to push top planar surface 15 back toward base plate 11 to reseal upper attachment flange 23 against base plate 11.

In certain cases, depending upon the size of the blister package and the thickness of the copolyester material, it is desireable to enhance the flexibility induced by transverse concave indentation 20 by providing semicircular notches 24 and 25 in the juxtaposed edges of side walls 16 and 17, immediately adjacent to the ends of transverse concave indentation 20. In this manner concave indentation 20 provides or serves as a more flexible hinge between the upper and lower portions of plastic assembly A second method of enhancing flexibility as shown in FIG. 5, is slits 27 which extend arcuately up from side walls 17 adjacent to transverse indentation 20. In practice it has been found that slit 27 provides the same enhanced flexibility as do semicircular notches 24 and 25, and slits 27 are easier to form when forming the entire plastic blister assembly 13.

While there is shown and described the present preferred embodiment of the invention, it is to be distinctly understood that this invention is not limited thereto but may be variously embodied to practice within the scope of the following claims.

I claim:

1. A resealable package comprising:

a planar base surface;

a top planar surface having opposing sides and opposing ends, said top planar surface further having a concave indentation formed therein and extending transversely across said top planar surface from side to side so as to form a first portion of said top planar surface on one side of the concave indentation and a second portion of said top planar surface on the other side;

a pair of first portion opposing side walls and an interconnecting end wall, for holding the top planar surface in spaced relationship to the planar base surface, extending out from the sides and end of the first portion of the top planar surface;

means for permanently attaching said first portion side walls and end wall to the planar base surface;

a pair of second portion opposing side walls and an interconnecting end wall, for attachment to the planar base surface, extending out from the sides and end of the second portion of said top planar surface; and means for removably attaching said second portion opposing side walls and end wall to the planar base surface.

2. The resealable blister package assembly of claim 1 wherein the means for attaching the first portion side walls and end wall to the planar base surface further comprises a first attachment flange circumvolving the first portion side walls and interconnecting end wall, attached to the planar base surface.

3. The resealable blister package assembly of claim 1 wherein the means for removably attaching said second portion opposing side walls and end wall to the planar base surface comprises:

a second attachment flange circumvolving said second portion opposing side walls and end wall; and a reusable adhesive for attaching said second attachment flange to the planar base surface.

4. The resealable blister package assembly of claim 2 wherein the means for removably attaching said second portion opposing side walls and end wall to the planar base surface comprises:

a second attachment flange circumvolving said second portion opposing side walls and end wall; and a reusable adhesive for attaching said second attachment flange to the planar base surface.

5. The resealable blister package assembly of claim 1 wherein said first and second portion opposing side walls each have notches formed therein in juxtaposed relationship to each other and adjacent to the side edges of the concave indentation formed in the top planar surface.

6. the resealable blister package assembly of claim 1 wherein said second portion opposing side walls each have arcuately shaped slits formed therein adjacent to the side edges of the concave indentation formed in the top planar surface.

7. The resealable blister package assembly of claim 1 wherein said top planar surface, said first and second portion end and side walls, and first and second attachment flanges are formed of a glycol modified polyethylene terephthalate material.

8. A resealable package comprising:

a planar base surface;

a top planar surface having opposing sides and opposing ends, said top planar surface further having a concave indentation formed therein and extending transversely across said top planar surface from side to side so as to form a first portion of said top planar surface on one side of the concave indentation and a second portion of said top planar surface on the other side;

a pair of first portion opposing side walls and an interconnecting end wall for holding the top planar surface in spaced relationship to the planar base surface extending out from the sides and end of the first portion of the top planar surface;

a first attachment flange circumvolving the first portion side walls and interconnecting end wall, attached to the planar base surface;

means for permanently attaching said first attachment flange to the planar base surface;

a pair of second portion opposing side walls and an interconnecting end wall for attachment to the planar base surface extending out from the sides and end of the second portion of said top planar surface;

a second attachment flange circumvolving said second portion opposing side walls and end wall; and a reusable adhesive for attaching said second attachment flange to the planar base surface.

9. The resealable blister package assembly of claim 7 wherein said top planar surface, said first and second portion end and side walls, and first and second attachment flanges are formed of a glycol modified polyethylene terephthalate material.

* * * * *